US007798791B2

(12) United States Patent
Byun et al.

(10) Patent No.: US 7,798,791 B2
(45) Date of Patent: Sep. 21, 2010

(54) CAPACITY VARYING TYPE ROTARY COMPRESSOR AND REFRIGERATION SYSTEM HAVING THE SAME

(75) Inventors: Sang-Myung Byun, Gyeongsangnam-Do (KR); Seoung-Yeon Cho, Gyeongsangnam-Do (KR); Seong-Jae Hong, Gyeongsangnam-Do (KR); Jeong-Hun Kim, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 384 days.

(21) Appl. No.: 11/666,284

(22) PCT Filed: Jan. 2, 2006

(86) PCT No.: PCT/KR2006/000006

§ 371 (c)(1),
(2), (4) Date: Apr. 25, 2007

(87) PCT Pub. No.: WO2006/090977

PCT Pub. Date: Aug. 31, 2006

(65) Prior Publication Data

US 2008/0193310 A1 Aug. 14, 2008

(30) Foreign Application Priority Data

| | | |
|---|---|---|
| Feb. 23, 2005 | (KR) | 10-2005-0015127 |
| Feb. 23, 2005 | (KR) | 10-2005-0015128 |
| May 19, 2005 | (KR) | 10-2005-0042209 |
| Dec. 30, 2005 | (KR) | 10-2005-0136068 |
| Dec. 30, 2005 | (KR) | 10-2005-0136075 |

(51) Int. Cl.
*F03C 2/00* (2006.01)
*F04C 2/00* (2006.01)

(52) U.S. Cl. ..... 418/26; 418/15; 418/23; 418/24; 418/60

(58) Field of Classification Search ..... 418/15, 418/22, 23, 24, 60, 62, 63, 65, 11, 212, 26; 417/213, 440, 310
See application file for complete search history.

(56) References Cited

U.S. PATENT DOCUMENTS 5,170,636 A * 12/1992 Hitosugi ..... 62/175

(Continued)

FOREIGN PATENT DOCUMENTS

CN 1467379 1/2004

(Continued)

OTHER PUBLICATIONS

International Search Report dated May 10, 2006.

(Continued)

*Primary Examiner*—Thomas E Denion
*Assistant Examiner*—Mary A Davis
(74) *Attorney, Agent, or Firm*—Ked & Associates LLP

(57) ABSTRACT

A capacity varying type rotary compressor and a refrigeration system having the same are provided. The capacity varying type rotary compressor includes a casing that contains a certain amount of oil and maintains a discharge pressure state; a motor installed in the casing that generates a driving force; one or more cylinder assembly fixed in the casing, having a compression space that compresses a refrigerant by a rolling piston that performs an orbit motion and a vane that performs a linear motion by contacting the rolling piston, and having a vane pressure chamber formed at a rear side of the vane that implements a normal driving as the vane contacts the rolling piston or a saving driving as the vane is separated from the rolling piston; and a mode switching device that selectively supplies a suction pressure or a discharge pressure to the vane pressure chamber of the cylinder assembly according to a driving mode.

11 Claims, 14 Drawing Sheets

U.S. PATENT DOCUMENTS

| | | | | |
|---|---|---|---|---|
| 5,545,021 | A * | 8/1996 | Fukuoka et al. | 418/63 |
| 5,775,882 | A * | 7/1998 | Kiyokawa et al. | 418/11 |
| 6,257,846 | B1 | 7/2001 | Muramatsu et al. | |
| 6,258,293 | B1 * | 7/2001 | Iizuka et al. | 252/68 |
| 7,540,727 | B2 * | 6/2009 | Byun et al. | 418/60 |
| 2001/0029744 | A1 | 10/2001 | Ryu | 62/324.6 |
| 2004/0009083 | A1 | 1/2004 | Kim et al. | 418/23 |
| 2006/0002809 | A1 * | 1/2006 | Kawabe et al. | 418/63 |
| 2008/0003123 | A1 * | 1/2008 | Byun et al. | 418/23 |
| 2008/0031756 | A1 * | 2/2008 | Hwang et al. | 418/23 |

FOREIGN PATENT DOCUMENTS

| | | |
|---|---|---|
| JP | 57-129286 | 8/1982 |
| JP | 58030498 | 2/1983 |
| JP | 58-70484 | 5/1983 |
| JP | 58-88486 | 5/1983 |
| JP | 59-39794 | 3/1984 |
| JP | 63-55389 | 3/1988 |
| JP | 02191894 | 7/1990 |
| JP | 5-256286 | 10/1993 |
| JP | 6-58280 | 3/1994 |
| JP | 6-307363 | 11/1994 |
| JP | 2003-254276 | 9/2003 |
| JP | 2004-44571 | 2/2004 |
| JP | 2004-301114 | 10/2004 |
| JP | 2005-9455 | 1/2005 |
| WO | WO 2004083642 A1 * | 9/2004 |

OTHER PUBLICATIONS

Chinese Office Action dated Jul. 10, 2009 (with translation). Document is in Japanese.

* cited by examiner

CAPACITY VARYING TYPE ROTARY COMPRESSOR AND REFRIGERATION SYSTEM HAVING THE SAME

TECHNICAL FIELD

The present invention relates to a rotary compressor and a refrigeration system having the same, and more particularly, to a capacity varying type rotary compressor capable of supporting a vane by forming a hermetic vane pressure chamber at a rear side of a vane slot and by supplying a suction pressure and a discharge pressure to the vane pressure chamber.

BACKGROUND ART

Generally, an air conditioner serves to maintain an indoor room as a comfortable state by maintaining an indoor temperature as a set temperature. The air conditioner comprises a refrigeration system. The refrigeration system comprises a compressor for compressing a refrigerant, a condenser for condensing a refrigerant compressed by the compressor and emitting heat outwardly, an expansion valve for lowering a pressure of a refrigerant condensed by the condenser, and an evaporator for evaporating a refrigerant that has passed through the expansion valve and absorbing external heat.

In the refrigeration system, when a compressor is operated as power is supplied thereto, a refrigerant of a high temperature and a high pressure discharged from the compressor sequentially passes through the condenser, the expansion valve, and the evaporator, and then is sucked into the compressor. The above process is repeated. In the above process, the condenser generates heat and the evaporator generates cool air by absorbing external heat. The heat generated from the condenser and the cool air generated from the evaporator are selectively circulated into an indoor room, thereby maintaining the indoor room as a comfortable state.

A compressor constituting the refrigeration system is various. Especially, a compressor applied to an air conditioner includes a rotary compressor, a scroll compressor, etc.

The most important factor in fabricating the air conditioner is to minimize a fabrication cost for a product competitiveness and to minimize a power consumption.

In order to minimize a power consumption of the air conditioner, the air conditioner is driven according to a load of an indoor room where the air conditioner is installed, that is, a temperature condition. That is, when the indoor temperature is drastically increased, the air conditioner is in a power mode so as to generate much cool air according to the drastic temperature variance (an excessive load). On the contrary, when the indoor temperature is varied with a small width, the air conditioner is in a saving mode so as to generate less cool air to maintain a preset indoor temperature.

In order to implement the modes, an amount of a refrigerant compressed by the compressor and discharged is controlled thereby to vary a refrigerating capacity of the refrigeration system.

As a method for controlling the amount of a refrigerant discharged from the compressor, an inverter motor is applied to the compressor thereby to vary an rpm of a driving motor of the compressor. An rpm of the driving motor of the compressor is controlled according to a load of an indoor room where the air conditioner is installed, and thus an amount of a refrigerant discharged from the compressor is controlled. An amount of heat generated from the condenser and cool air generated from the evaporator is controlled by varying the amount of a refrigerant discharged from the compressor.

However, in case of applying the inverter motor to the compressor, a fabrication cost is increased due to high price of the inverter motor thereby to degrade a price competitiveness.

Accordingly, a technique for varying a capacity of a compression chamber by partially bypassing a refrigerant compressed in a cylinder of the compressor to outside of the cylinder is being widely researched. However, according to the technique, a pipe system for bypassing a refrigerant to outside of the cylinder is complicated thereby to increase a refrigerant resistance and thus to degrade an efficiency.

DISCLOSURE OF THE INVENTION

Therefore, an object of the present invention is to provide a capacity varying type rotary compressor capable of enhancing a refrigerating efficiency by increasing a lowering rate of a cooling capability at the time of a saving mode and capable of simplifying a construction thereof.

Another object of the present invention is to provide a capacity varying type rotary compressor capable of facilitating a connection operation of a pipe for a capacity variation and capable of enhancing a refrigerating efficiency by preventing a pressure leakage.

To achieve these and other advantages and in accordance with the purpose of the present invention, as embodied and broadly described herein, there is provided a capacity varying type rotary compressor, comprising: a casing containing a certain amount of oil and maintaining a discharge pressure state; a motor installed in the casing and generating a driving force; one or more cylinder assembly fixed in the casing, having a compression space for compressing a refrigerant by a rolling piston that performs an orbit motion and a vane that performs a linear motion by contacting the rolling piston, and having a vane pressure chamber formed at a rear side of the vane, for implementing a normal driving as the vane contacts the rolling piston or implementing a saving driving as the vane is separated from the rolling piston; and a mode switching unit for selectively supplying a suction pressure or a discharge pressure to the vane pressure chamber of the cylinder assembly according to a driving mode.

To achieve these and other advantages and in accordance with the purpose of the present invention, as embodied and broadly described herein, there is also provided a refrigeration system comprising the capacity varying type rotary compressor, a condenser, an expansion valve, and an evaporator in a closed circuit.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

MODES FOR CARRYING OUT THE PREFERRED EMBODIMENTS

Reference will now be made in detail to the preferred embodiments of the present invention, examples of which are illustrated in the accompanying drawings.

Figure 1:
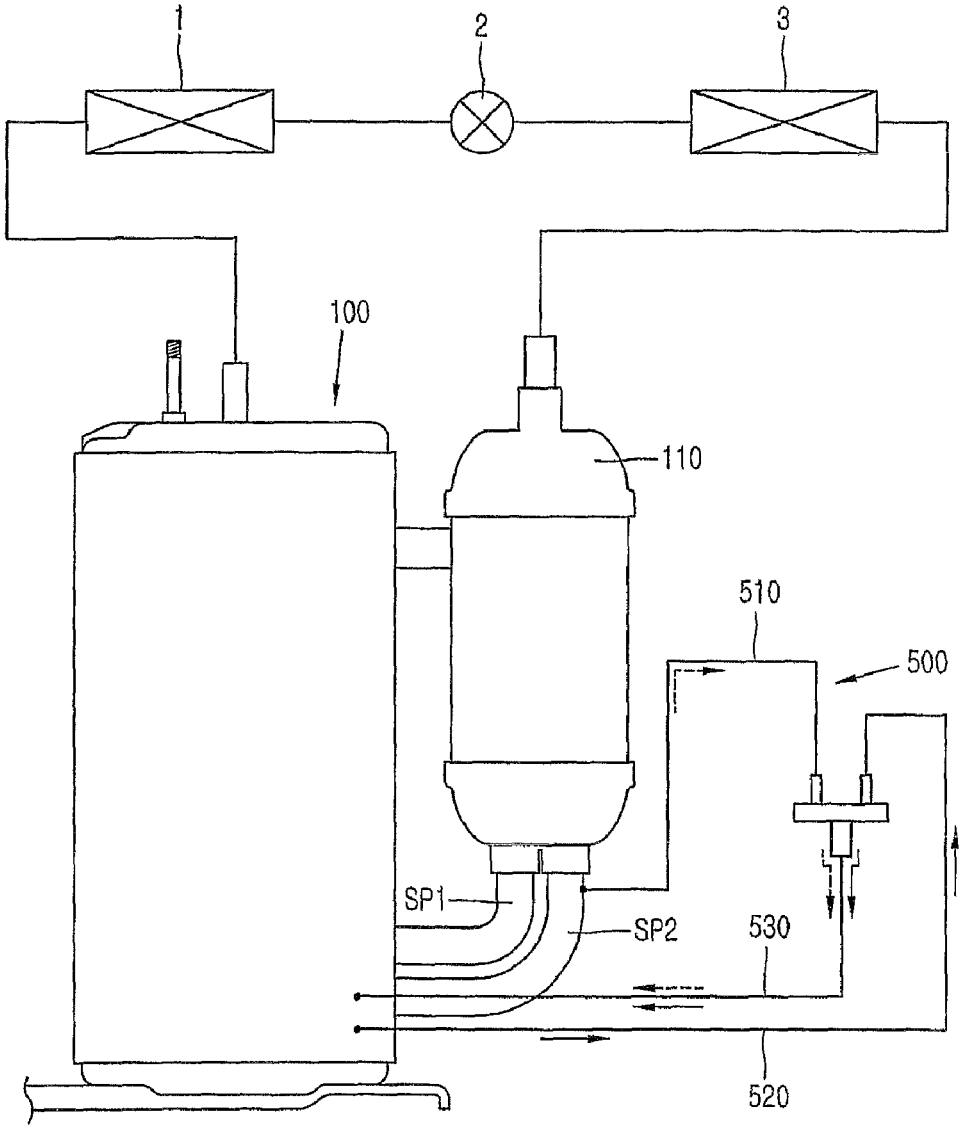
FIG. 1 is a diagram showing a refrigerating cycle having a capacity variable double type rotary compressor according to the present invention.
Figure 2:
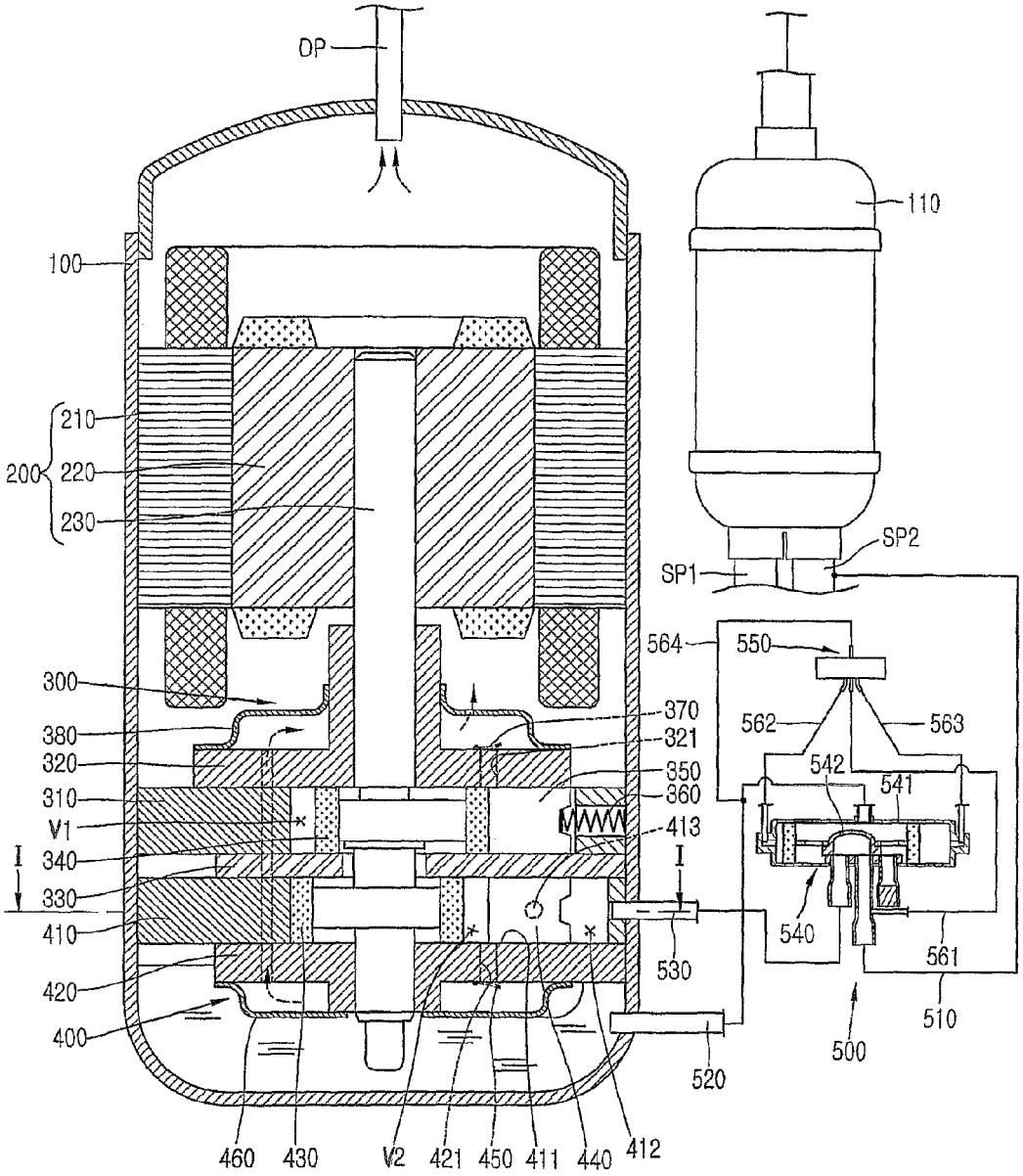
FIG. 2 is a longitudinal section view showing a capacity variable double type rotary compressor according to the present invention.
Figure 3:
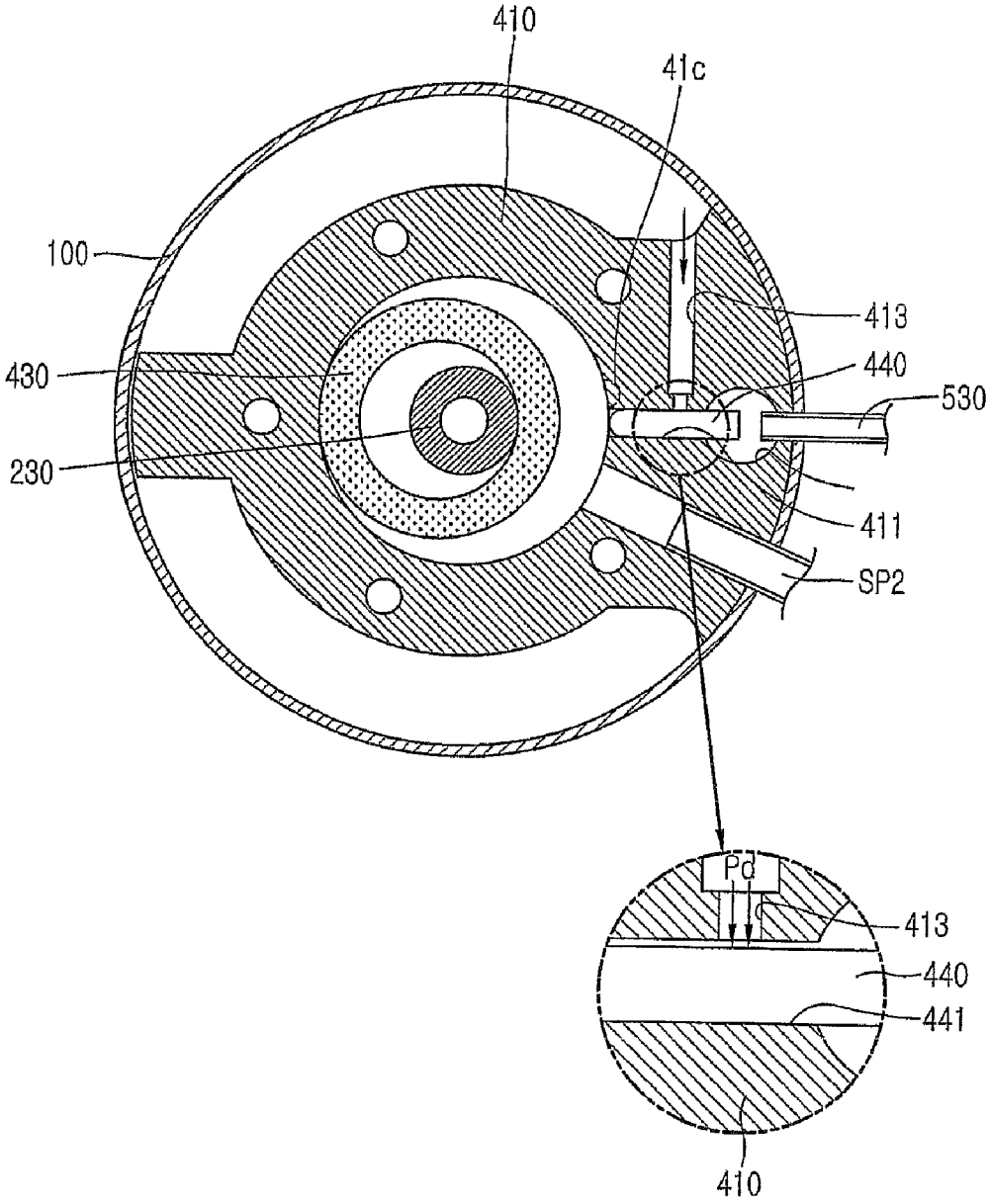
FIG. 3 is a section view taken along line 'l-l' of FIG. 2.
Figure 4:
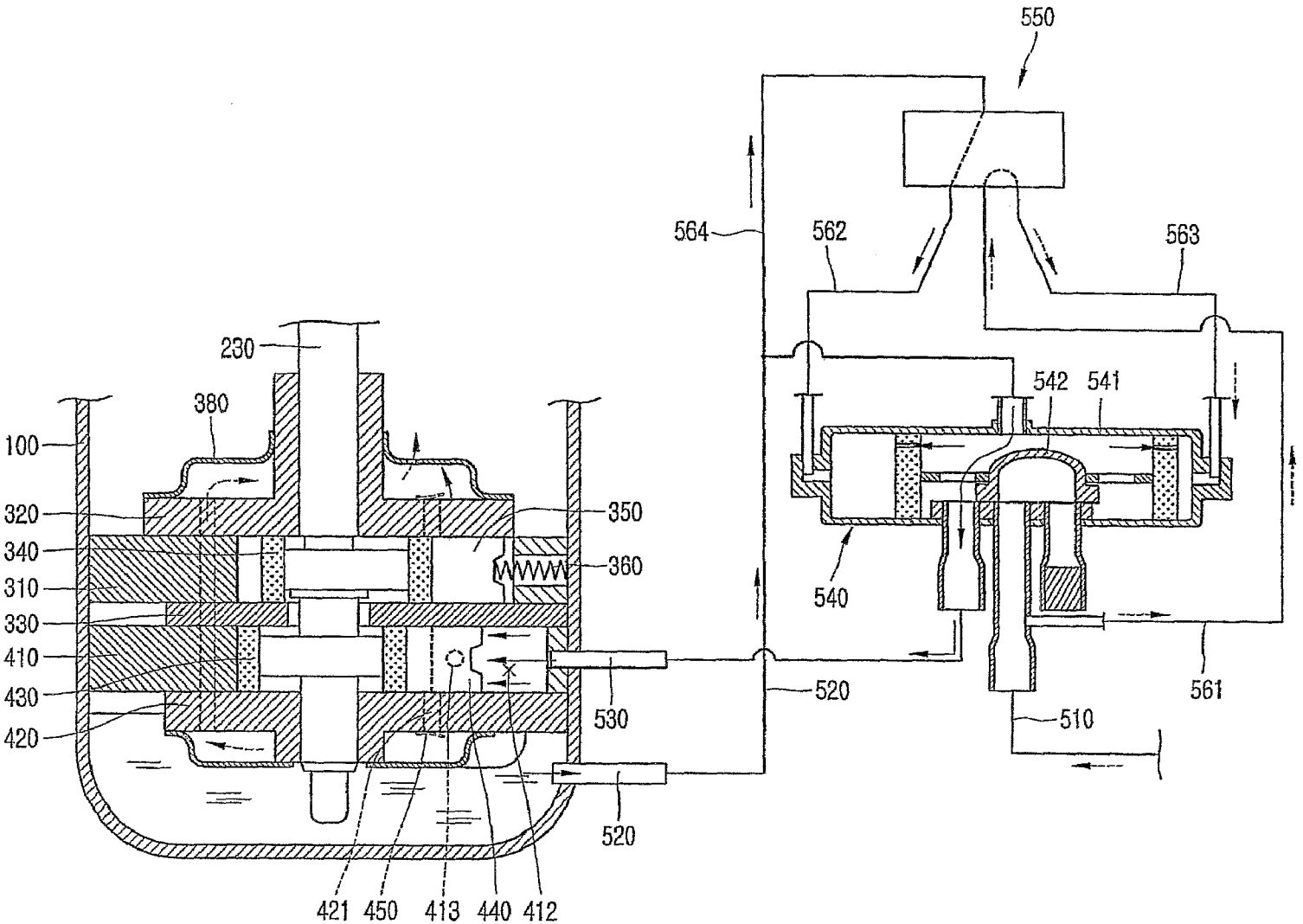
FIGS. 4 and 5 are longitudinal section views showing a power mode and a saving mode according to a first embodiment for restricting a vane in the capacity variable double type rotary compressor according to the present invention.
Figure 5:
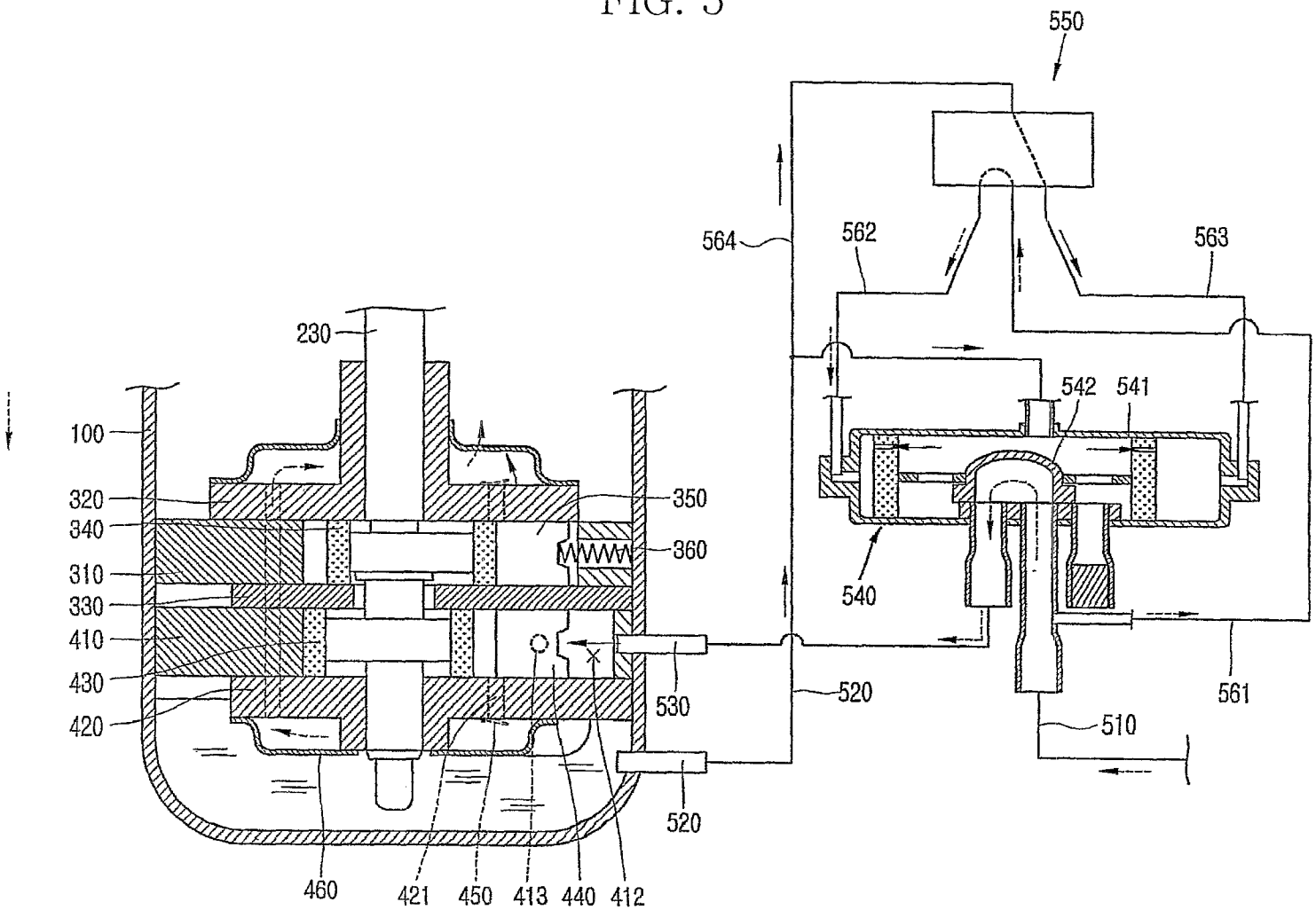

FIG. 1 is a diagram showing a refrigerating cycle having a capacity variable double type rotary compressor according to the present invention, FIG. 2 is a longitudinal section view showing a capacity variable double type rotary compressor according to the present invention, FIG. 3 is a section view taken along line 'l-l' of FIG. 2, and FIGS. 4 and 5 are longitudinal section views showing a power mode and a saving mode according to a first embodiment for restricting a vane in the capacity variable double type rotary compressor according to the present invention.

As shown in FIGS. 1 and 2, a double type rotary compressor according to the present invention comprises a casing 100 to which a plurality of gas suction pipes SP1 and SP2 and one gas discharge pipe DP are connected, a motor part 200 installed at an upper side of the casing 100 and generating a rotation force, a first compression part 300 and a second compression part 400 installed at a lower side of the casing 100 for compressing a refrigerant by a rotation force generated from the motor part 200, and a mode switching unit 500 for switching a rear surface of a second vane 440 of the second compression part 400 into a high pressure atmosphere or a low pressure atmosphere and implementing the second compression part 400 in a power mode or a saving mode.

The motor part 200 performs a constant speed driving or a variable speed (inverter) driving. As shown in FIG. 2, the motor part 200 comprises a stator 210 installed in the casing 100 and receiving power applied from outside, a rotor 220 disposed in the stator 210 with a certain air gap and rotated by being interacted with the stator 210, and a rotation shaft 230 coupled to the rotor 220 for transmitting a rotation force to the first compression part 300 and the second compression part 400.

The first compression part 300 comprises a first cylinder 310 having a ring shape and installed in the casing 100, an upper bearing plate 320 (hereinafter, an upper bearing) and a middle bearing plate 330 (hereinafter, a middle bearing) covering upper and lower sides of the first cylinder 310 thereby forming a first compression space (V1) for supporting the rotation shaft 230 in a radial direction, a first rolling piston 340 rotatably coupled to an upper eccentric portion of the rotation shaft 230 and compressing a refrigerant with orbiting in the first compression space V1 of the first cylinder 310, a first vane 350 coupled to the first cylinder 310 to be movable in a radial direction so as to be in contact with an outer circumferential surface of the first rolling piston 340 for dividing the first space V1 of the first cylinder 310 into a first suction chamber and a first compression chamber, a vane supporting spring 360 formed of a compression spring for elastically supporting a rear side of the first vane 350, a first discharge valve 370 openably coupled to an end of a first discharge opening 321 provided in the middle of the upper bearing 320 for controlling a discharge of a refrigerant discharged from the compression chamber of the first compression space V1, and a first muffler 380 having an inner volume to receive the first discharge valve 370 and coupled to the upper bearing 320.

The second compression part 400 comprises a second cylinder 410 having a ring shape and installed at a lower side of the first cylinder 310 inside the casing 100, a middle bearing 330 and a lower bearing plate 420 covering upper and lower sides of the second cylinder 410 thereby forming a second compression space (V2) for supporting the rotation shaft 230 in a radial direction and in a shaft direction, a second rolling piston 430 rotatably coupled to a lower eccentric portion of the rotation shaft 230 and compressing a refrigerant with orbiting in the second compression space V2 of the second cylinder 410, a second vane 440 coupled to the second cylinder 410 to be movable in a radial direction so as to contact/separate to/from an outer circumferential surface of the second rolling piston 430 for dividing the second space V2 of the second cylinder 410 into a second suction chamber and a second compression chamber or connecting the suction chamber and the compression chamber to each other, a second discharge valve 450 openably coupled to an end of a second discharge opening 421 provided in the middle of the lower bearing 420 for controlling a discharge of a refrigerant discharged from the second compression chamber, and a second muffler 460 having an inner volume to receive the second discharge valve 450 and coupled to the lower bearing 420.

As shown in FIG. 2, the second cylinder 410 comprises a second vane slot 411 formed at one side of an inner circumferential surface thereof constituting the second compression space V2 for reciprocating the second vane 440 in a radial direction, a second inlet (not shown) formed at one side of the second vane slot 411 in a radial direction for introducing a refrigerant into the second compression space V2, and a second discharge guiding groove (not shown) inclinably installed in a shaft direction for discharging a refrigerant into the casing 100. A vane pressure chamber 412 connected to a common side connection pipe 530 of a valve unit 500 that will be later explained for maintaining a rear side of the second vane 440 as a suction pressure atmosphere or a discharge pressure atmosphere is hermetically formed at a rear side of the second vane slot 411 in a radial direction. Also, a lateral pressure passage 413 for connecting inside of the casing 100 to the second vane slot 411 in a perpendicular direction or an inclined direction to a motion direction of the second vane 440 and thereby restricting the second vane 440 by a discharge pressure inside the casing 100 is formed at the second cylinder 410.

A compression space of the second cylinder 410 can have the same or different capacity as/from the compression space V1 of the first cylinder 310. For instance, under a state that the two cylinders 310 and 410 have the same capacity, if one cylinder performs a saving mode, the compressor is driven with a capacity corresponding to the capacity of another cylinder and thus a function of the compressor is varied into 50%. However, under a state that the two cylinders 310 and 410 have different capacities, if one cylinder performs a saving mode, the function of the compressor is varied into a ratio corresponding to a capacity of another cylinder that performs a normal driving.

The vane pressure chamber 412 is connected to the common side connection pipe 530, and has a certain inner volume so that a rear surface of the second vane 440 that has been completely moved backward thus to be received in the second vane slot 411 can have a pressure surface for a pressure supplied through the common side connection pipe 530.

As shown in FIG. 3, the lateral pressure passage 413 is positioned at a discharge guiding groove (not shown) of the second cylinder 410 based on the second vane 440, and is penetratingly formed towards the center of the second vane slot 411 from an outer circumferential surface of the second cylinder 410. The lateral pressure passage 413 is formed to have a two-step narrowly formed towards the second vane slot 411 by using a two-step drill. An outlet of the lateral pressure passage 413 is formed at an approximate middle part of the second vane slot 411 in a longitudinal direction so that the second vane 440 can perform a stable linear reciprocation. Preferably, a sectional area of the lateral pressure passage 413 is equal or narrower to/than a longitudinal sectional area of the second vane slot 411, that is, a sectional area of the rear surface of the second vane 440, thereby preventing the second vane 440 from being excessively restricted. It is also possible that the lateral pressure passage 413 is provided in plurality along a height direction of the second vane 440 (in drawing, upper and lower lateral pressure passages).

The mode switching unit 500 comprises a suction pressure side connection pipe 510 diverged from a second gas suction pipe SP2, a discharge pressure side connection pipe 520 connected to an inner space of the casing 100, a common side connection pipe 530 connected to the vane pressure chamber 412 of the second cylinder 410 and connected to the suction pressure side connection pipe 510 and the discharge pressure side connection pipe 520, a first mode switching valve 540 connected to the vane pressure chamber 412 of the second cylinder 410 by the common side connection pipe 530, and a second mode switching valve 550 connected to the first mode switching valve 540 and serving as a pilot valve for controlling an open/close operation of the first mode switching valve 540.

The suction pressure side connection pipe 510 is connected between a suction side of the second cylinder 410 and an inlet side gas suction pipe of an accumulator 110, or between a suction side of the second cylinder 410 and an outlet side gas suction pipe (second gas suction pipe SP2).

The discharge pressure side connection pipe 520 can be connected to a lower portion of the casing 100 thereby to directly introduce oil inside the casing 100 into the vane pressure chamber 412, or can be diverged from a middle part of the gas discharge pipe DP. Herein, as the vane pressure chamber 412 becomes hermetic, oil may not be supplied between the second vane 440 and the second vane slot 411 and thus a frictional loss may be generated. Accordingly, an oil supply hole (not shown) is formed at the lower bearing 420 thereby to supply oil between the second vane 440 and the second vane slot 411 when the second vane 440 performs a reciprocation.

As shown in FIG. 2, the first mode switching valve 540 comprises a first valve housing 541 having a certain inner space and having a cylindrical shape, and a first sliding valve 542 slidably inserted into the first valve housing 541 for controlling a suction pressure or a discharge pressure to be supplied to the vane pressure chamber 412.

One circumferential surface of a middle portion of the first valve housing 541 is connected to a middle portion of the second gas suction pipe SP2 and an inner space of the casing 100 through the suction pressure side connection pipe 510 and the discharge pressure side connection pipe 520. Another circumferential surface of the middle portion of the first valve housing 541 is connected to the vane pressure chamber 412 of the second cylinder 410 through the common side connection pipe 530.

Both ends of the first valve housing 541 are connected to the second mode switching valve 550 through a second capillary tube 562 and a third capillary tube 563 that will be later explained.

The second mode switching valve 550 is provided with a first capillary tube 561 to be connected to the suction pressure side connection pipe 510. The second capillary tube 562 and the third capillary tube 563 respectively connected to both sides of the first valve housing 541 are installed at both sides of the first capillary tube 561. A fourth capillary tube 564 is connected between the second mode switching valve 550 and the discharge pressure side connection pipe 520 so as to be selectively connected to the second capillary tube 562 and the third capillary tube 563.

The same reference numerals are given to the same parts as the conventional parts.

Unexplained reference numeral 1 denotes a condenser, 2 denotes an expansion device, and 3 denotes an evaporator.

An operation of the capacity variable double type rotary compressor according to the present invention will be explained.

When the rotor 220 is rotated as power is supplied to the stator 210 of the motor part 200, the rotation shaft 230 is rotated together with the rotor 220 thereby to transmit a rotation force of the motor part 200 to the first compression part 300 and the second compression part 400. When the first compression part 300 and the second compression part 400 are together normally driven, a cooling capacity of a large capacitance is generated. However, when the first compression part 300 performs a normal driving and the second compression part 400 performs a saving driving, a cooling capacity of a small capacitance is generated.

When the compressor or a refrigeration system having the same is normally driven, power is applied to the second mode switching valve 550. Accordingly, as shown in FIG. 4, the first capillary tube 561 and the third capillary tube 563 are connected to each other, and thus a refrigerant of the suction pressure side is introduced into the right side of the first valve housing 541 as indicated by the dotted line arrow. Also, the second capillary tube 562 and the fourth capillary tube 564 are connected to each other, and high pressure gas or high pressure oil inside the casing 100 is introduced into the left side of the first valve housing 541 as indicated by the solid line arrow.

Accordingly, the first sliding valve 542 moves towards the third capillary tube 563 and thus the suction pressure side connection pipe 510 is blocked. On the contrary, the discharge pressure side connection pipe 520 is connected to the common side connection pipe 530, and thus discharged oil or refrigerant of a high pressure is supplied to the vane pressure chamber 412 of the second cylinder 410. As the result, the second vane 440 is moved towards the second rolling piston 430 by a pressure of the vane pressure chamber 412 thus to be in contact with the second rolling piston 430, thereby compressing refrigerant gas introduced into the second compression space V2 and then discharging the refrigerant gas. Herein, refrigerant gas or oil of a high pressure is supplied to the vane pressure chamber 412 through the lateral pressure passage 413 provided at the second cylinder 410. However, since a sectional area of the lateral pressure passage 413 is smaller than a sectional area of the second vane slot 411 in a radial direction, a pressurizing force of the vane pressure chamber 412 in a lateral direction is smaller than a pressurizing force of the vane pressure chamber 412 in back and forth directions. As the result, the second vane 440 is not restricted, and thus second vane 440 is continuously reciprocated in back and forth directions as the second rolling piston 430 performs an orbit motion.

The first vane 350 and the second vane 440 are respectively in contact with the rolling pistons 340 and 430 thereby to divide the first compression space V1 and the second compression space V2 into a suction chamber and a compression chamber. As the first vane 350 and the second vane 440 compress each refrigerant sucked into each suction chamber and discharge the refrigerant, the compressor or a refrigeration system having the same performs a driving of 100%.

On the contrary, when the compressor or the refrigeration system having the same performs a saving driving likewise the initial driving, as shown in FIG. 5, the second mode switching valve 550 is operated in an opposite manner to the normal driving. As the result, the suction pressure side connection pipe 510 and the common side connection pipe 530 are connected to each other, a refrigerant of a low pressure is introduced into the vane pressure chamber 412, and the second vane 440 is moved towards the vane pressure chamber 412 by a pressure of the second compression space V2 that is a relatively high pressure. Accordingly, the second vane 440 is separated from the second rolling piston 430, and thus the suction chamber and the compression chamber of the second compression space V2 are connected to each other. Therefore, a refrigerant sucked into the second compression space V2 is leaked to the suction chamber thereby not to be compressed, so that the second compression part 400 can not perform a compression operation. Oil or refrigerant gas of a high pressure is introduced into the lateral pressure passage 413 provided at the second cylinder 410 thereby to restrict the second vane 440 in the second vane slot 411. As the result, the second vane 440 can not be moved under a separated state from the second rolling piston 430.

The compression chamber and the suction chamber of the second cylinder 410 are connected to each other, an entire refrigerant sucked into the suction chamber of the second cylinder 410 is not compressed but is sucked into the suction chamber along a locus of the rolling piston 430. As the result, the second compression part 400 does not perform a compression operation, so that the compressor or a refrigeration system having the same performs a driving corresponding to only the capacity of the first compression part 300.

Another embodiment for restricting the vane in the capacity varying type rotary compressor according to the present invention will be explained.

In the aforementioned embodiment, a discharge pressure inside the casing is induced into a lateral surface of the second vane thereby to restrict the second vane by the discharge pressure. However, according to another embodiment, a pin assembly 600 installed in a second muffler 460 is used to restrict the second vane 440 as shown in FIGS. 6 and 7.

The pin assembly comprises a stopper pin 610 pressurized towards the second vane 440 by an inner pressure of the second muffler 460, that is, an inner pressure of the casing 100 for restricting a pin insertion groove 441 of the second vane 440, and a pin spring 620 interposed between the stopper pin 610 and a lower surface of the lower bearing 420 for restoring the stopper pin 610 when a pressure difference between the vane pressure chamber 412 of the second cylinder 410 and the inner volume of the second muffler 460 is not generated, and for dividing the second compression space V2 into a compression chamber and a suction chamber as the second vane 440 is smoothly linearly-reciprocated.

Figure 6:
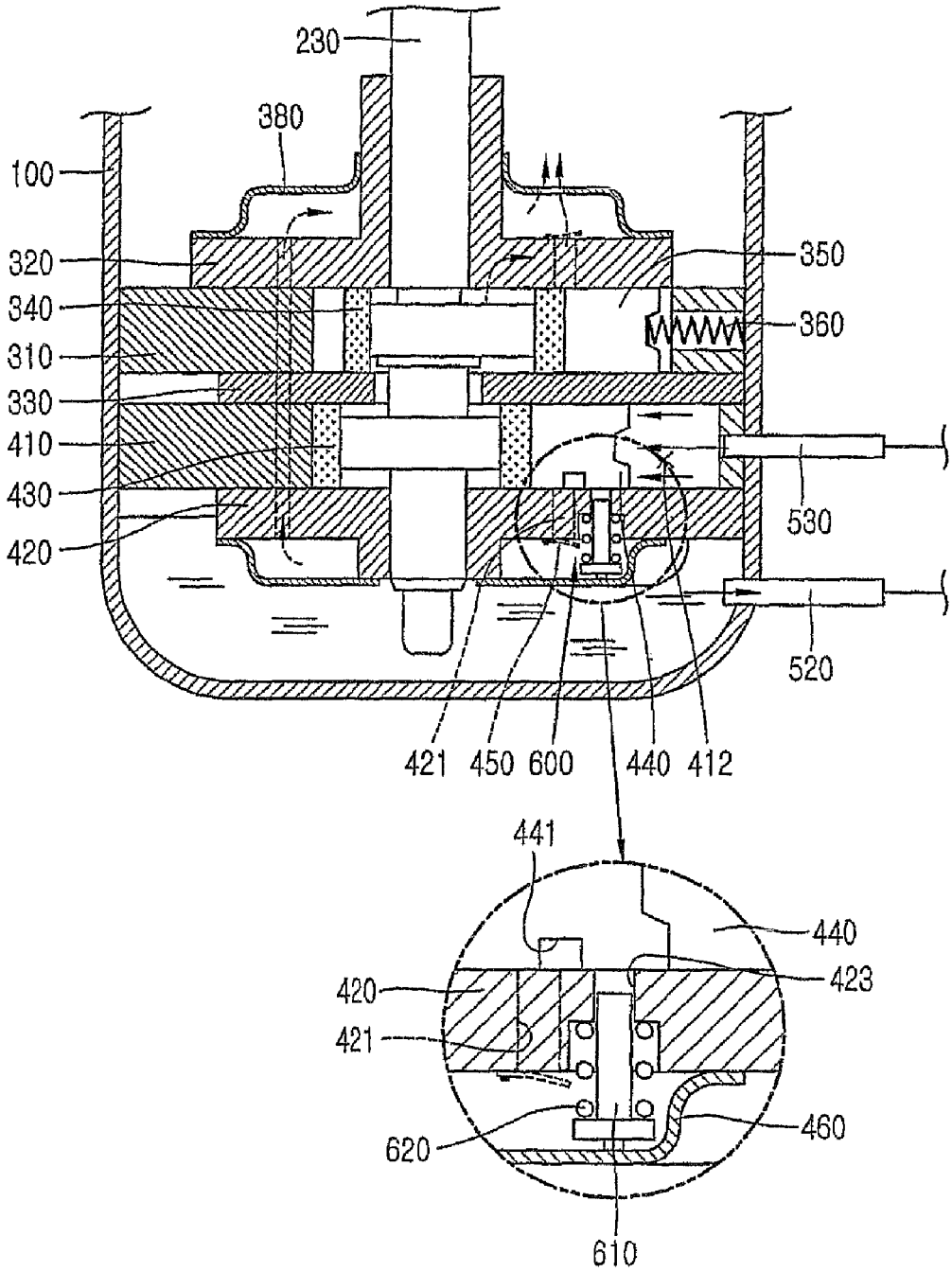
FIGS. 6 and 7 are longitudinal section views showing a power mode and a saving mode according to another embodiment for restricting a vane in the capacity variable double type rotary compressor according to the present invention.

As shown in FIG. 6, in the pin assembly for restricting the vane in the capacity varying type rotary compressor according to the present invention, when the compressor performs a normal driving, a discharge pressure is supplied to the vane pressure chamber 412 and thus a pressure of the vane pressure chamber 412 becomes approximately equal to a pressure inside the second muffler 460. Accordingly, the stopper pin 610 is moved downward by an elastic force of the pin spring 620 thus to be separated from the second vane 440, thereby not restricting the second vane 440.

Figure 7:
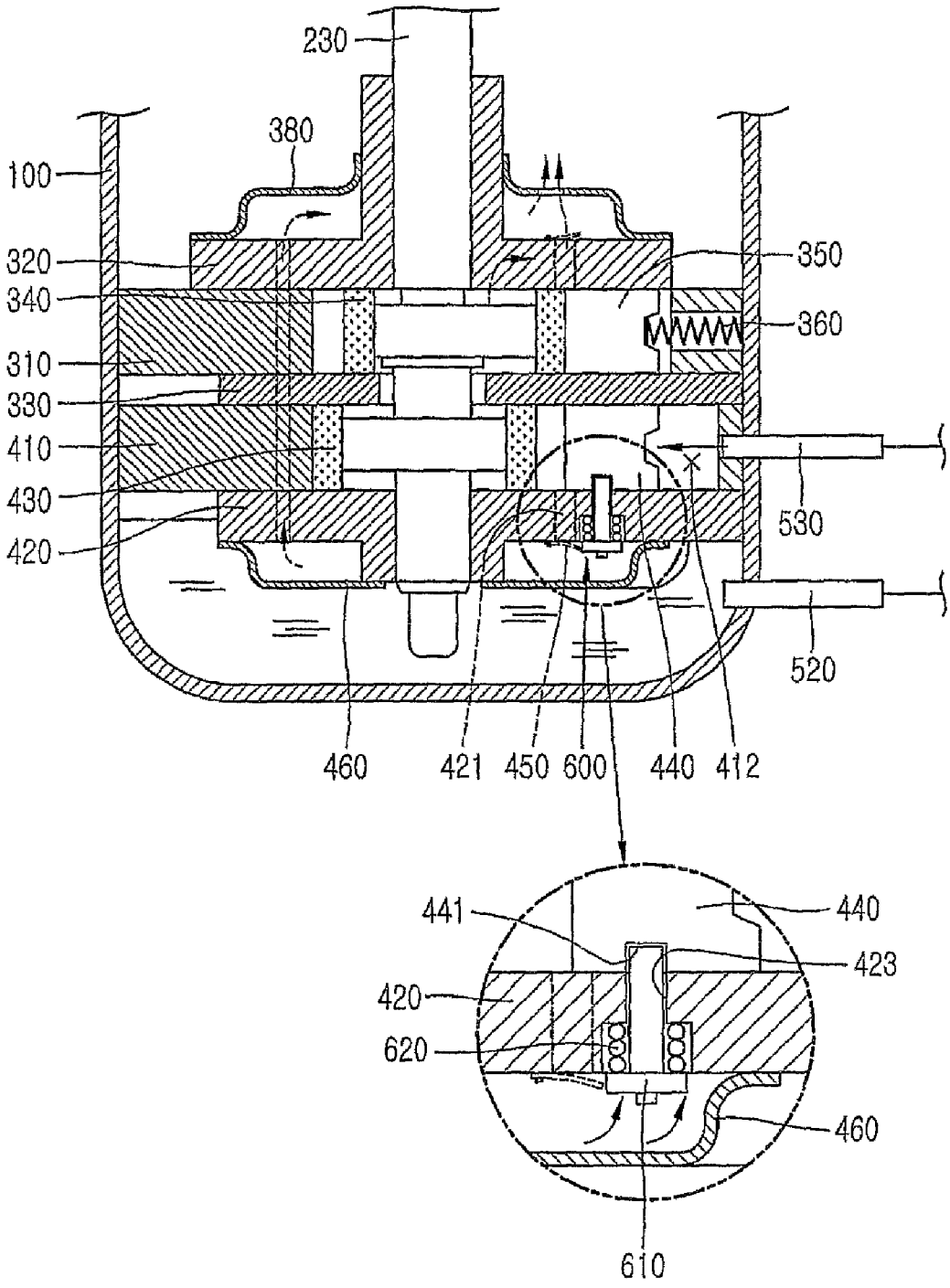

On the contrary, when the compressor performs a saving driving as shown in FIG. 7, a suction pressure is supplied to the vane pressure chamber 412 and thus the pressure of the vane pressure chamber 412 becomes lower than the pressure inside the second muffler 460. Accordingly, the stopper pin 610 is moved upwardly by the pressure inside the second muffler 460 and the elastic force of the pin spring 620, thereby restricting the second vane 440.

Figure 8:
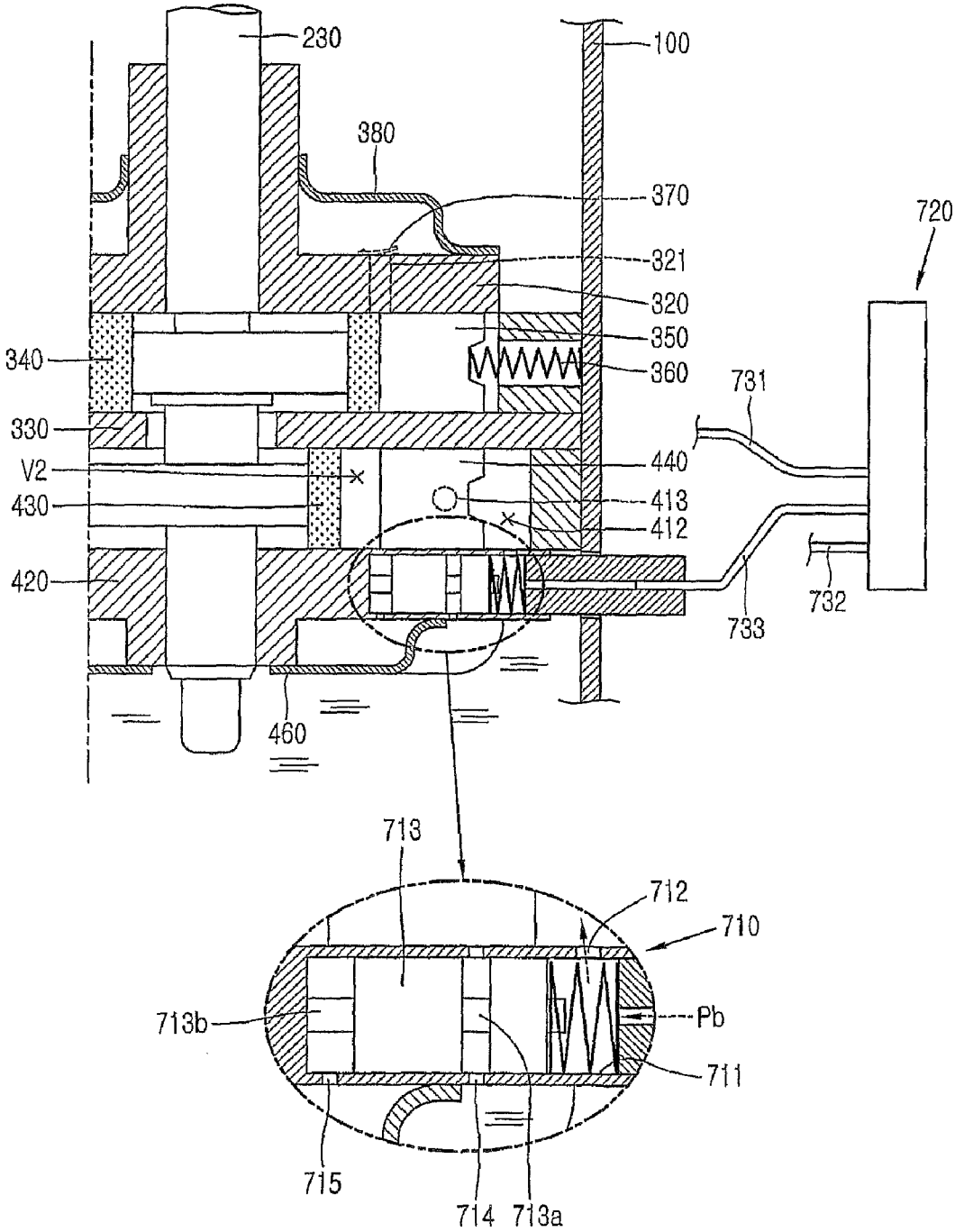
FIGS. 8 to 10 are longitudinal section views showing preferred embodiments of a mode switching unit in the capacity variable double type rotary compressor according to the present invention.
Figure 9:
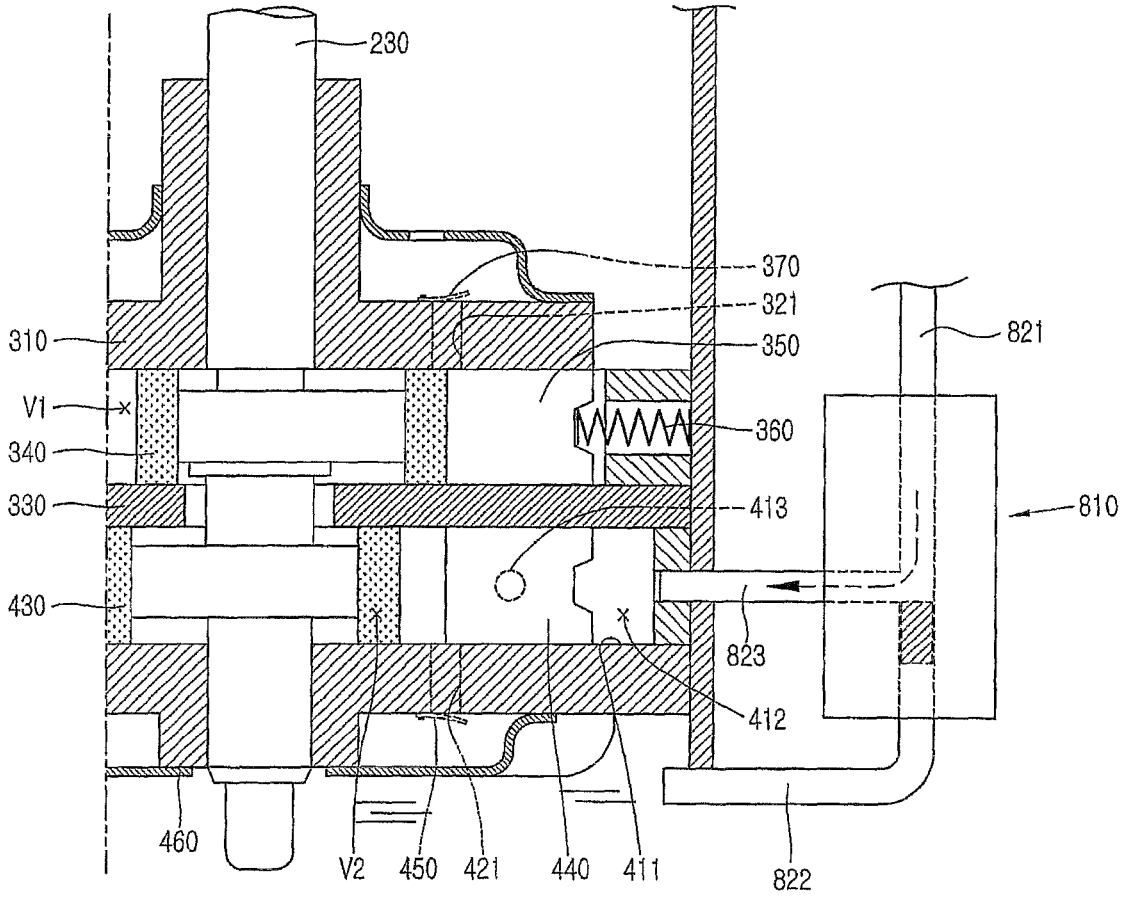
Figure 10:
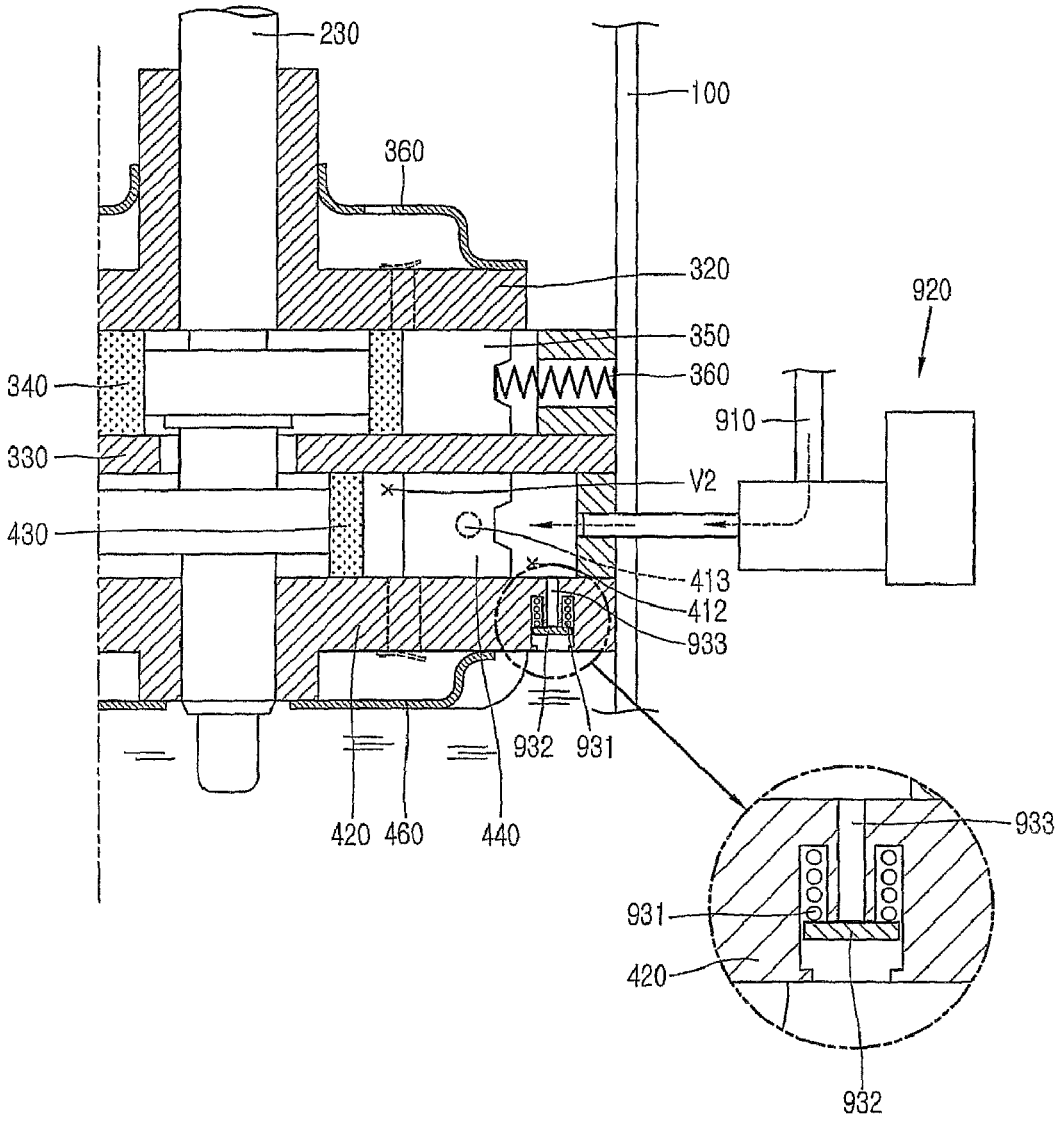

As the mode switching unit of the capacity varying type rotary compressor according to the present invention, a pilot valve, a three-way valve, a two-way valve, an actuator, etc. can be used besides the component of the aforementioned embodiment shown in FIGS. 8 to 10.

As shown in FIG. 8, in case of the mode switching unit using a pilot valve, a first mode switching valve 710 is installed in the casing 100, and a second mode switching valve 720 connected to the first mode switching valve 710 and connected to a plurality of capillary tubes for controlling an operation of the first mode switching valve 710 is installed outside the casing 100.

In the capacity varying type rotary compressor using a pilot valve according to the present invention, when the compressor or the refrigeration system having the same performs a normal driving, a discharge pressure is supplied to a valve hole 711 of the first mode switching valve 710 provided at the lower bearing 420 by the second mode switching valve 720. At the same time, refrigerant gas of the discharge pressure is introduced into the vane pressure chamber 412 of the second cylinder 410 through a back pressure hole 712, and the second vane 440 is moved by a pressure of the vane pressure chamber 412 thereby to be in contact with the second rolling piston 430. As the result, the compressor performs a compression operation as much as the capacity of the first cylinder 310 and the second cylinder 420. During this process, a sliding valve 713 inserted into the valve hole 711 is moved thereby to open an oil supply hole 714. Accordingly, oil is introduced into the second vane slot 411 thereby to lubricate between the second vane 440 and the second vane slot 411.

On the contrary, when the compressor or the refrigeration system having the same performs a saving driving, a suction pressure is supplied to the valve hole 711 by the second mode switching valve 720. Accordingly, the second vane 440 is received in the second vane slot 411 thus to be separated from the second rolling piston 430. As the result, the compression chamber and the suction chamber of the second cylinder 410 are connected to each other, and refrigerant gas is leaked to the suction chamber from the compression chamber. Accordingly, the second compression part 400 does not perform a compression operation. Unexplained reference numeral 713*a* denotes a connecting portion, 713*b* denotes a gap maintaining portion, 731 denotes a low pressure side capillary tube, 732 denotes a high pressure side capillary tube, and 733 denotes a common side capillary tube.

As shown in FIG. 9, in case of the mode switching unit using a three-way valve, a mode switching valve 810 that is a three-way valve is installed at a connection portion among a suction pressure side connection pipe 821, a discharge pressure side connection pipe 822, and a common side connection pipe 823, thereby selectively connecting the suction pressure side connection pipe 821 and the discharge pressure side connection pipe 822 to the common side connection pipe 823.

In the capacity varying type rotary compressor using a three-way valve according to the present invention, when the compressor or the refrigeration system having the same performs a normal driving, the three-way valve 810 is operated thereby to connect the discharge pressure side connection pipe 822 and the common side connection pipe 823 to each other. Accordingly, oil of a high pressure is introduced into the vane pressure chamber 412 of the second cylinder 410, and thus the second vane 440 is moved by the pressure of the vane pressure chamber 412 thereby to be in pressure-contact with the second rolling piston 430. As the result, refrigerant gas introduced into the second compression space V2 is normally compressed, and thus the compressor performs a compression operation as much as the capacity of the first cylinder 310 and the second cylinder 410. The vane pressure chamber 412 becomes hermetic by the middle bearing 330 and the lower bearing 420. However, oil inside the casing 100 is introduced into the vane pressure chamber 412 through the discharge pressure side connection pipe 820, thereby lubricating between the second vane slot 411 and the second vane 440. On the contrary, when the compressor or the refrigeration system having the same performs a saving driving, the three-way valve 810 is operated in an opposite manner to the normal driving thereby to connect the suction pressure side connection pipe 821 and the common side connection pipe 823 to each other. Accordingly, refrigerant gas of a low pressure sucked into the second cylinder 410 is partially introduced into the vane pressure chamber 412 of the second cylinder 410, and the second vane 440 is moved by a pressure of the second compression space V2 thereby to be received in the second vane slot 411. As the result, the suction chamber and the compression chamber of the second compression space V2 are connected to each other, and thus refrigerant gas sucked into the second compression space V2 is not compressed but is leaked. Accordingly, the compressor performs a compression operation as much as a capacity of the first cylinder 310.

As shown in FIG. 10, in case of the mode switching unit using a two-way valve, a first mode switching valve 920 that is an on/off valve for controlling a supply of a refrigerant of a suction pressure to the vane pressure chamber 412 is installed in the middle of a suction pressure side connection pipe 910 outside the casing 100. A second mode switching valve 930 for closing the vane pressure chamber 412 so that the vane pressure chamber 412 can maintain a low pressure when the first mode switching valve 920 is opened and for opening the vane pressure chamber 412 so that the vane pressure chamber 412 can maintain a high pressure as the discharge pressure of the casing 100 is introduced into the vane pressure chamber 412 when the first mode switching valve 920 is closed is installed at the lower bearing 420.

In the capacity varying type rotary compressor using a two-way valve according to the present invention, when the compressor or the refrigeration system having the same performs a normal driving, the first mode switching valve 920 that is a two-way valve is closed and thus an inner pressure of the vane pressure chamber 412 becomes an approximate average between a suction pressure and a discharge pressure. Under the state, force obtained by adding a gas force of the vane pressure chamber 412 to an elastic force of a back pressure controlling spring 931 provided at the second mode switching valve 930 is greater than the inner pressure of the casing 100, and thus a back pressure controlling valve 932 supported by the back pressure controlling spring 931 is opened. As the back pressure controlling valve 932 is opened, oil inside the casing 100 is introduced into the vane pressure chamber 412 through an opened back pressure controlling hole 933, and the vane pressure chamber 412 forms a high pressure by the oil thus to support the second vane 440. Accordingly, the compression chamber and the suction chamber of the second cylinder are separated from each other thereby to continuously compress a refrigerant, so that the compressor performs a compression operation of 100%. On the contrary, when the compressor or the refrigeration system having the same performs a saving driving, the first mode switching valve 920 is opened and thus the vane pressure chamber 412 has a low pressure. Accordingly, the back pressure switching valve is moved by the pressure inside the casing thereby to overcome the elastic force of the back pressure controlling spring and to block the back pressure controlling hole. As the vane pressure chamber 412 maintains a low pressure, the second vane 440 is backward moved thereby to be received in the second vane slot 411, and the compression chamber and the suction chamber of the second cylinder are connected to each other. As the result, the second compression part does not perform a compression operation, but only the first compression part performs a compression operation.

As the method for restricting the second vane received in the second vane slot by each mode switching unit, the lateral pressure passage can be applied to use a gas pressure like in the aforementioned embodiment, or a pin assembly can be applied.

In case of installing the capacity variable type apparatus at each cylinder of the rotary compressor using a plurality of cylinders, a refrigerating capability of the compressor can be switched into three-step.

For instance, under a state that the first cylinder 310 and the second cylinder 410 have a capacity ratio of 7:3, when both the first compression part 300 and the second compression part 400 are normally driven, the compressor implements a refrigerating capability of 100% (70+30).

When the first compression part 300 performs a normal driving and the second compression part 400 performs a saving driving, the compressor implements a refrigerating capability of 70%.

When the first compression part 300 performs a saving driving and the second compression part 400 performs a normal driving, the compressor implements a refrigerating capability of 30%.

Since the compressor or the refrigeration system having the same can switch a refrigerating capability into three-step, more enhanced comfort and efficiency can be implemented in the refrigeration system.

Figure 11:
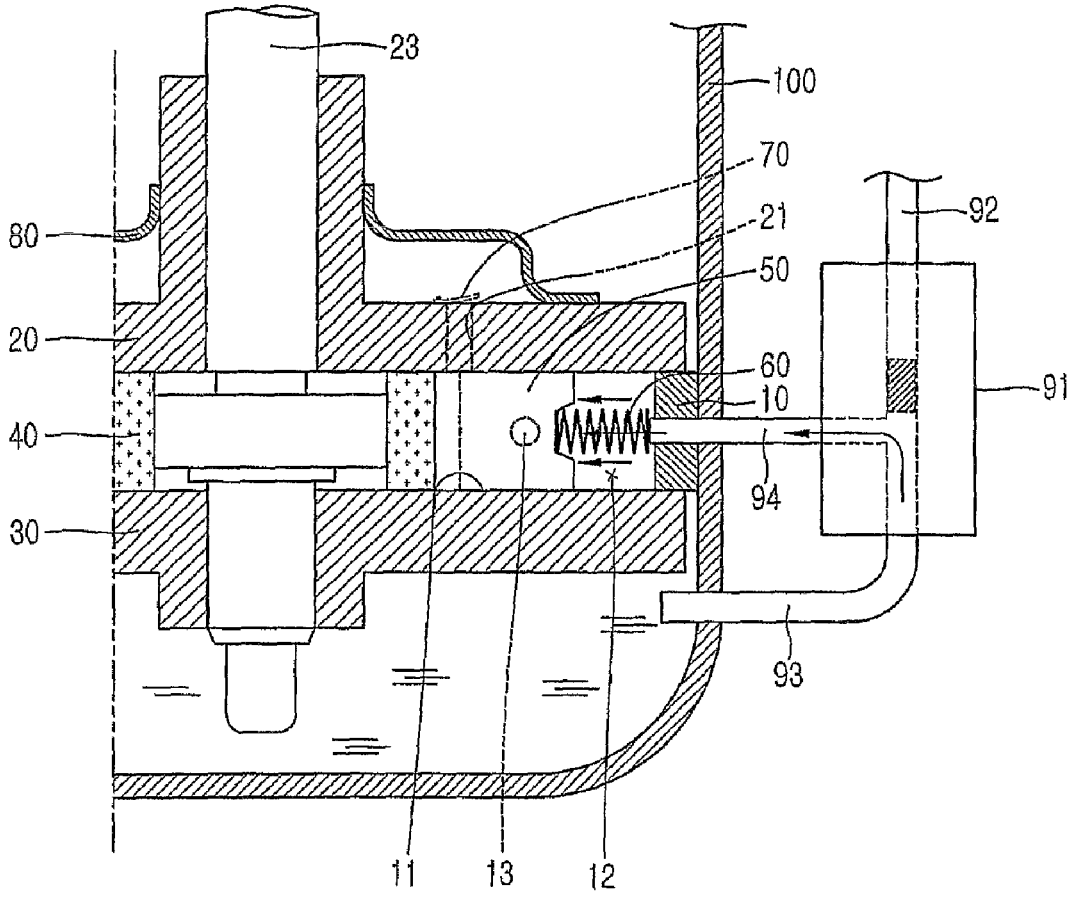
FIG. 11 is a longitudinal section view showing a capacity variable single type rotary compressor according to the present invention.

In the aforementioned embodiment, the double type rotary compressor having a plurality of cylinders was explained. However, a single type rotary compressor having one cylinder 10 as shown in FIG. 11 can be applied to the present invention. In the single type rotary compressor, when an inner pressure of the casing 100 does not form a discharge pressure at the time of driving the compressor, gas force for restricting the vane 50 may not be generated. Therefore, a vane spring 60 formed of a compression spring is preferably provided at the vane pressure chamber 12.

When the compressor is driven, the cylinder 10 performs a suction operation and a compression operation. Herein, when a mode switching valve 91 is in a normal driving state, the vane pressure chamber 12 becomes a high pressure and thus the compressor continuously implements a normal driving. Then, when the mode switching valve 91 is switched into a saving driving mode and the saving driving mode is maintained for a long time, a pressure difference of the refrigeration system is decreased. When the mode switching valve 91 is switched into a normal driving mode, the vane spring 60 is operated, thus the vane 50 becomes in contact with the rolling piston 40, and thereby the compressor implements a normal driving. Unexplained reference numeral 11 denotes a vane slot, 13 denotes a lateral pressure passage, 20 denotes an upper bearing, 21 denotes a discharge opening, 30 denotes a lower bearing, 70 denotes a discharge valve, 80 denotes a muffler, 92 denotes a suction pressure side connection pipe, 93 denotes a discharge pressure side connection pipe, and 94 denotes a common side connection pipe.

In the present invention, a rotary compressor having one cylinder repeatedly performs a normal driving and a saving driving, and thus a refrigerating capability of the system can be controlled. Also, since the van can be completely received in the vane slot by high pressure gas introduced through the lateral pressure passage at the time of a saving driving, a compression loss is not generated and a refrigerating capability having a high efficiency is implemented. Furthermore, the entire structure is simplified thus to enhance a productivity and to lower a production cost.

The capacity variable type apparatus can enhance a function of a double type rotary compressor and a single type rotary compressor having not only a constant speed motor but also a variable speed motor (inverter motor). Generally, the inverter motor varies a capacity of the compressor by implementing different rotation speeds according to a load. However, when the rpm of the inverter motor is decreased less than 20 Hz or is increased more than 90 Hz, vibration is generated. Especially, when the rpm of the inverter motor is less than 20 Hz, oil suction is difficult. Therefore, the inverter motor has a limitation in varying the rpm thereof. However, when the capacity varying type rotary compressor according to the present invention is applied, a capacity of the compressor can be more increased or more decreased even in the limitation range. Accordingly, in the present invention, a capacity varying ability for the compressor and a cooling capability varying ability for the refrigeration system having the compressor can be enhanced, and thus more enhanced comfort and energy saving can be implemented.

Figure 12:
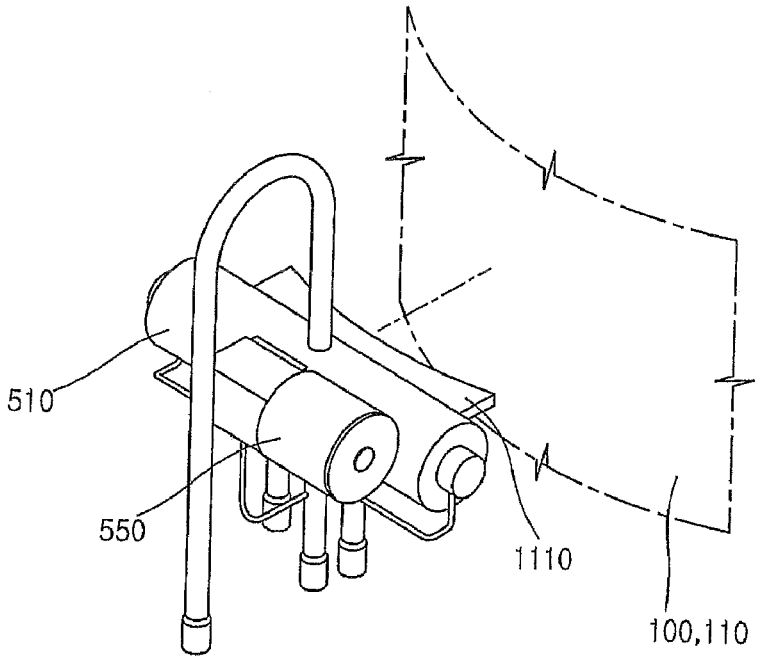
FIGS. 12 to 14 are perspective views showing preferred embodiments of a valve supporting unit for supporting a valve unit in the capacity variable double type rotary compressor according to the present invention.
Figure 13:
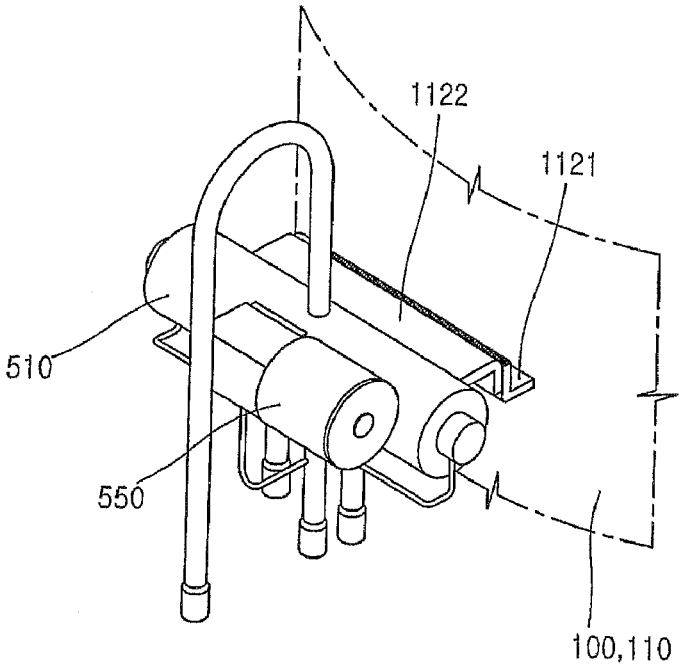
Figure 14:
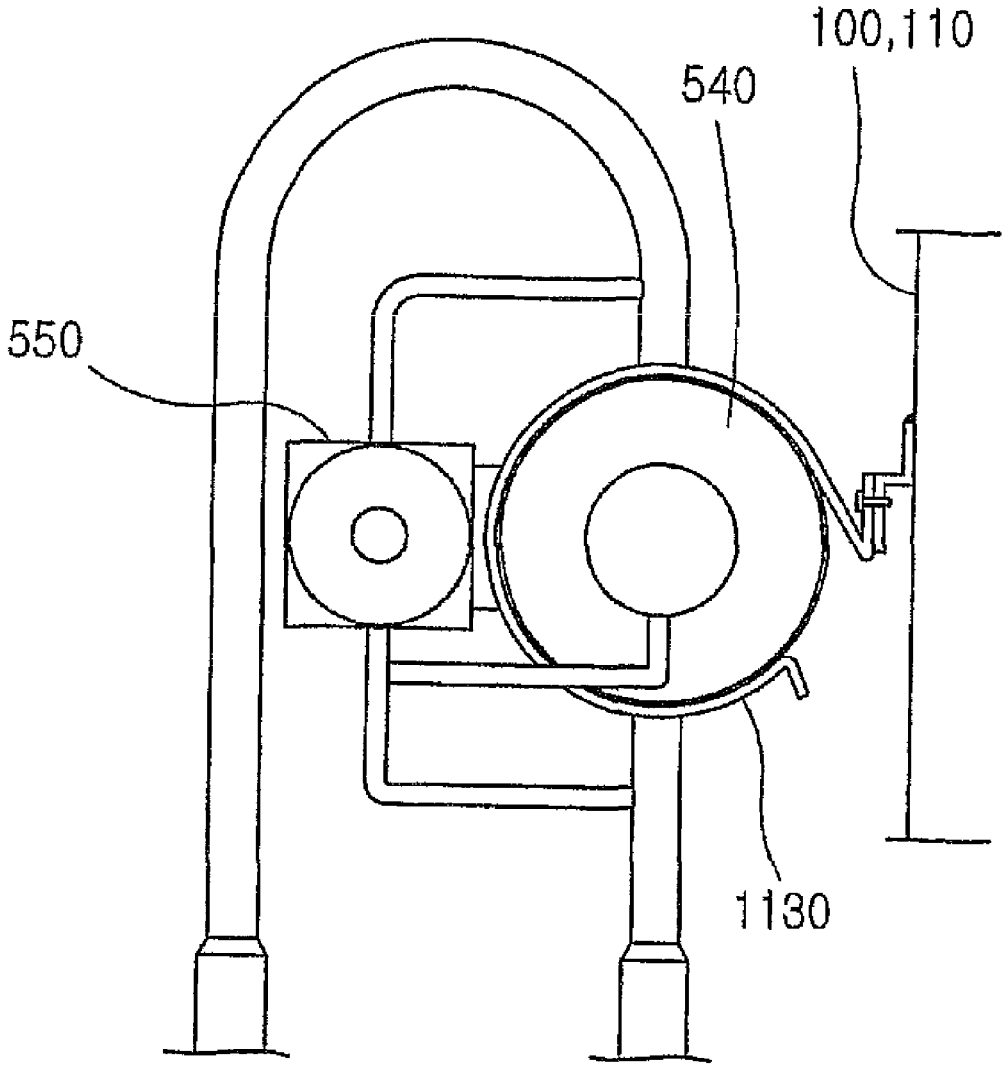

As shown in FIG. 12, the mode switching valves 540, 550, 720, 810, and 920 can be constructed as at least one bracket 1110 having one end fixed to an outer circumferential surface of the casing 100 or the accumulator 110 by a welding, a bolting, etc. and having another end fixed to an outer circumferential surface of each mode switching valve by a welding, a bolting, etc. As shown in FIG. 13, the mode switching valves 540, 550, 720, 810, and 920 can be constructed as a first bracket 1121 fixed to an outer circumferential surface of the casing 100 or the accumulator 110 by a welding, a bolting, etc. and a second bracket 1122 coupled to the first bracket 1121 by a welding, a bolting, etc. and fixed to each of the mode switching valves by a welding, a bolting, etc. As shown in FIG. 14, the mode switching valves 540, 550, 720, 810, and 920 can be constructed as at least one clamp 130 having one end covering each mode switching valve thereby elastically supporting the mode switching valves, and another end fixed to the casing 100 or the accumulator 110 by a welding, a bolting, etc. The mode switching valves can be fixed to the casing 100 or the accumulator 110 by various methods, thereby preventing vibration of the compressor from being increased.

Figure 15:
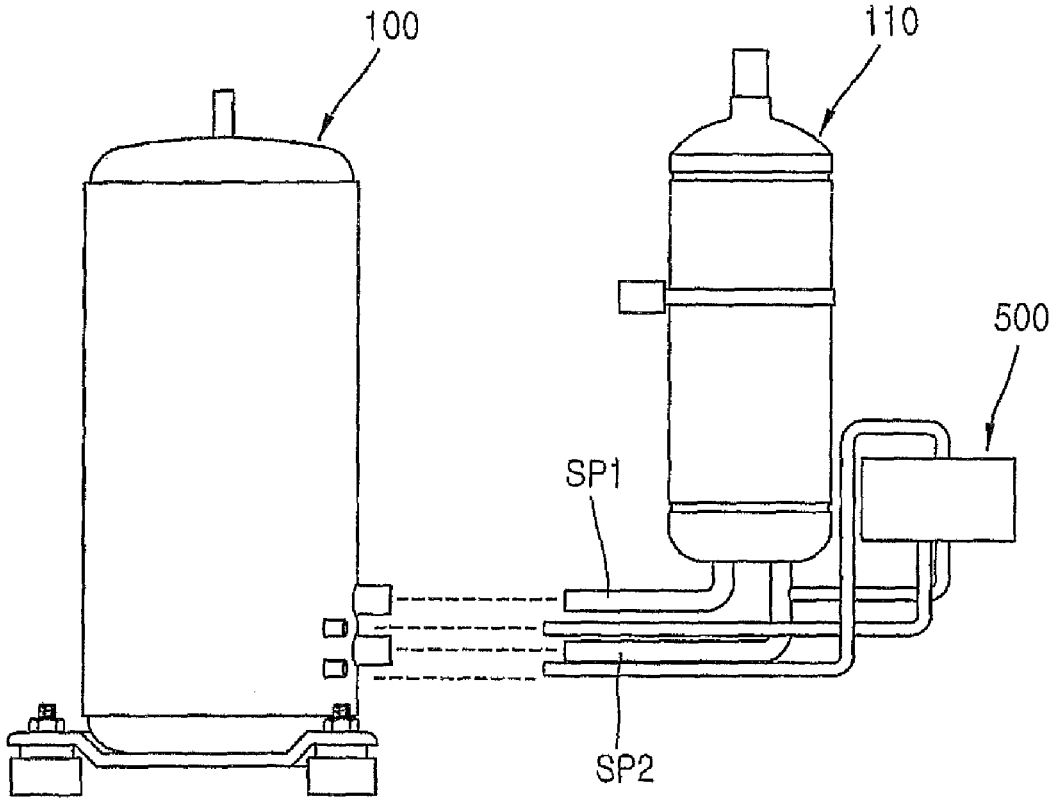
FIG. 15 is a schematic view showing an assembly operation of a valve unit and a connection unit in the capacity variable double type rotary compressor according to the present invention.

As shown in FIG. 15, under a state that each mode switching valve 540, 550, 720, 810, and 920 is fixed to the accumulator 110 by each bracket 1110, 1121, and 1122 or the clamp 1130, each connection pipe coupled to each of the mode switching valves is coupled to the second gas suction pipe (SP2) provided at the accumulator 110. Then, the connection pipes are connected to the casing 100 at a final assembly process, thereby simplifying the assembly process of the compressor and enhancing the productivity.

In the capacity varying type rotary compressor and the refrigeration system having the same according to the present invention, the installation of the pipes can be simplified, the capacity varying ability can be easily controlled even when the compressor is driven, and the valve has less cooling capability loss thereby to enhance a driving efficiency. Furthermore, since the refrigeration system can implement an easy mode switching, comfort and energy saving are enhanced. Also, an interference between the pipes is prevented, thereby minimizing the refrigeration system and enhancing the assembly characteristic. Additionally, since the number of the valves of the refrigeration system is decreased, the production cost can be reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

The invention claimed is:

1. A capacity varying type rotary compressor, comprising:

a casing that contains a certain amount of oil and a refrigerant maintained at a discharge pressure in an inner space of the casing and having a gas discharge pipe that communicates with the inner space;

a motor fixedly installed in the inner space of the casing that generates a driving force;

a first cylinder fixedly installed in the inner space of the casing, having a first compression space to compress the refrigerant, and having a first inlet that supplies the refrigerant at a suction pressure to the first compression space;

a second cylinder fixedly installed in the inner space of the casing positioned at one side of the first cylinder, having a second compression space to compress the refrigerant separately from the first compression space of the first cylinder, and having a second inlet that supplies the refrigerant at a suction pressure to the second compression space;

an upper bearing installed at an upper side of the first cylinder such that the upper bearing covers the upper side of the first cylinder, and having a first outlet that communicates with the first compression space;

a lower bearing installed at a lower side of the second cylinder such that the lower bearing covers the lower side of the second cylinder, and having a second outlet that communicates with the second compression space;

a middle bearing that separates the first and second cylinders from each other;

a first rolling piston that performs an orbit motion in the first compression space of the first cylinder;

a second rolling piston that performs an orbit motion in the second compression space of the second cylinder;

a first vane coupled to the first cylinder that performs a linear motion by contacting the first rolling piston;

a second vane coupled to the second cylinder that performs a linear motion by contacting the second rolling piston;

a vane pressure chamber formed in the second cylinder at a rear side of the second vane in the inner space of the casing, and sealed by the lower and middle bearings such that the vane pressure chamber is separated from the inner space of the casing;

a suction pressure side connection pipe connected to the second inlet by passing through the casing;

a discharge pressure side connection pipe connected to the inner space of the casing by passing through the casing;

a common side connection pipe connected to the vane pressure chamber by passing through the casing;

a first mode switching valve connected to the suction pressure side connection pipe, the discharge pressure side connection pipe, and the common side connection pipe, that selectively connects the suction pressure side connection pipe and the discharge pressure side connection pipe to the common side connection pipe;

a second mode switching valve connected to the first mode switching valve, that connects the suction pressure side connection pipe and the discharge pressure side connection pipe to the first mode switching valve to control the first mode switching valve;

an accumulator fixed to the casing; and a connection device that couples the first mode switching valve to an outer circumferential surface of the accumulator.

2. The rotary compressor of claim 1, wherein the discharge side connection pipe communicates with the inner space of the casing from the lower side of the second cylinder, such that the oil inside the casing is supplied to the vane pressure chamber when the compressor performs a normal driving.

3. The rotary compressor of claim 2, wherein the oil inside the casing is supplied to the vane pressure chamber via the first and second mode switching valves.

4. The rotary compressor of claim 1, further comprising a vane restricting device that restricts the second vane under a state in which the second vane is separated from the second rolling piston.

5. The rotary compressor of claim 4, wherein the vane restricting device restricts the second vane by inducing a high pressure inside the casing to a lateral surface or upper and lower surfaces of the second vane and thus by adhering the second vane to the second cylinder.

6. The rotary compressor of claim 5, wherein the motor is a constant speed motor.

7. The rotary compressor of claim 5, wherein the motor is a variable speed motor.

8. The rotary compressor of claim 5, wherein the connection device includes one or more brackets each having one end fixed to the outer circumferential surface of the accumulator by welding or bolting and another end fixed to an outer circumferential surface of the first mode switching valve by welding or bolting.

9. The rotary compressor of claim 5, wherein the connection device includes:

a first bracket fixed to the accumulator by welding or bolting; and a second bracket fixed to the first bracket and the first mode switching valve by welding or bolting.

10. The rotary compressor of claim 5, wherein the connection device includes one or more clamps each having one end that elastically supports the first mode switching valve in a winding manner and another end fixed to the accumulator by welding or bolting.

11. A refrigeration system comprising a capacity varying type rotary compressor, a condenser, an expansion valve, and an evaporator as a closed circuit, the capacity varying type rotary compressor comprising:

a casing that contains a certain amount of oil and a refrigerant maintained at a discharge pressure in an inner space of the casing and having a gas discharge pipe that communicates with the inner space;

a motor fixedly installed in the inner space of the casing that generates a driving force;

a first cylinder fixedly installed in the inner space of the casing, having a first compression space to compress the refrigerant, and having a first inlet that supplies the refrigerant at a suction pressure to the first compression space;

a second cylinder fixedly installed in the inner space of the casing positioned at one side of the first cylinder, having a second compression space to compress the refrigerant separately from the first compression space of the first cylinder, and having a second inlet that supplies the refrigerant at a suction pressure to the second compression space;

an upper bearing installed at an upper side of the first cylinder such that the upper bearing covers the upper side of the first cylinder, and having a first outlet that communicates with the first compression space;

a lower bearing installed at a lower side of the second cylinder such that the lower bearing covers the lower side of the second cylinder, and having a second outlet that communicates with the second compression space;

a middle bearing that separates the first and second cylinders from each other;

a first rolling piston that performs an orbit motion in the first compression space of the first cylinder;

a second rolling piston that performs an orbit motion in the second compression space of the second cylinder;

a first vane coupled to the first cylinder that performs a linear motion by contacting the first rolling piston;

a second vane coupled to the second cylinder that performs a linear motion by contacting the second rolling piston;

a vane pressure chamber formed in the second cylinder at a rear side of the second vane in the inner space of the casing, and sealed by the lower and middle bearings such that the vane pressure chamber is separated from the inner space of the casing;

a suction pressure side connection pipe connected to the second inlet by passing through the casing;

a discharge pressure side connection pipe connected to the inner space of the casing by passing through the casing;

a common side connection pipe connected to the vane pressure chamber by passing through the casing;

a first mode switching valve connected to the suction pressure side connection pipe, the discharge pressure side connection pipe, and the common side connection pipe, that selectively connects the suction pressure side connection pipe and the discharge pressure side connection pipe to the common side connection pipe;

a second mode switching valve connected to the first mode switching valve, that connects the suction pressure side connection pipe and the discharge pressure side connection pipe to the first mode switching valve to control the first mode switching valve;

an accumulator fixed to the casing; and a connection device that couples the first mode switching valve to an outer circumferential surface of the accumulator.

* * * * *